US005392508A

United States Patent [19]

Holliday et al.

[11] Patent Number: 5,392,508

[45] Date of Patent: Feb. 28, 1995

[54] AXIAL DEFORMATION CRIMPING TOOL

[75] Inventors: Randall A. Holliday, Westminster; Donald Kesinger, Morrison, both of Colo.

[73] Assignee: Cable Ready, Inc., Denver, Colo.

[21] Appl. No.: 218,624

[22] Filed: Mar. 28, 1994

Related U.S. Application Data

[63] Continuation-in-part of Ser. No. 992,524, Dec. 17, 1992, abandoned.

[51] Int. Cl.[6] ..... H01R 43/042

[52] U.S. Cl. ..... 29/751; 29/280; 29/282; 29/758; 72/410

[58] Field of Search ..... 29/237, 253, 280, 282, 29/268, 745, 747, 748, 750, 751, 758, 761, 861, 862, 863, 33 M, 508; 72/409, 410, 412, 416; 81/355, 361, 126, 128, 129, 398, 421, 422; 254/134.3 CL

[56] References Cited

U.S. PATENT DOCUMENTS

| | | | |
|---|---|---|---|
| 3,325,885 | 6/1967 | Ziegler, Jr. et al. | 29/280 X |
| 3,417,599 | 12/1968 | Burno | 72/412 |
| 4,043,174 | 8/1977 | Padino | 72/410 X |
| 4,179,782 | 12/1979 | Forman et al. | 29/268 |
| 4,292,833 | 10/1981 | Lapp | 72/416 |
| 4,663,838 | 5/1987 | Dewey et al. | 29/280 X |
| 4,790,068 | 12/1988 | Sato | 29/761 |
| 4,794,780 | 1/1989 | Battenfeld | 29/751 X |
| 4,885,928 | 12/1989 | Davis et al. | 72/410 |
| 4,953,384 | 9/1990 | Baillet et al. | 72/410 |
| 5,040,288 | 8/1991 | Nilsson | 81/398 X |
| 5,094,097 | 3/1992 | Tooth, deceased et al. | 72/410 |
| 5,138,864 | 8/1992 | Tarpill | 72/410 |
| 5,211,049 | 5/1993 | Lucas | 81/421 X |

FOREIGN PATENT DOCUMENTS

| | | | |
|---|---|---|---|
| 3408683 | 9/1985 | Germany | 29/751 |
| 1285695 | 8/1972 | United Kingdom | 29/751 |

*Primary Examiner*—Peter Dungba Vo
*Attorney, Agent, or Firm*—John E. Reilly

[57] ABSTRACT

A crimping tool for connecting a cable fitting to the end of a coaxial cable is made up of one or more die members having tapered die surfaces of circular configuration, a chuck which is axially spaced from the die surfaces to support the fitting in loosely assembled relation to the end of the cable, and a handle is pivotally mounted in such a way as to cause axial movement of the chuck toward and away from the die surfaces and specifically to axially force the fitting into the die cavity and uniformly reduce the circumference of one end of the fitting into a generally conical configuration snugly engaging the cable.

20 Claims, 4 Drawing Sheets

AXIAL DEFORMATION CRIMPING TOOL

CROSS-REFERENCE TO RELATED APPLICATIONS

This application is a continuation-in-part application of Ser. No. 992,524, filed 17 Dec., 1992, for CRIMPING TOOL by Randall A. Holliday and Donald Kesinger now abandoned.

SPECIFICATION

This invention relates to crimping devices and more particularly relates to a novel and improved crimping tool for compressing fittings into uniform sealed engagement with cables, such as, coaxial cables used in the television industry.

BACKGROUND AND FIELD OF INVENTION

It has been the practice in the television industry to employ a hand-held crimping tool to attach the standard fitting onto the end of a coaxial cable, and the fitting can then be threadedly connected into the mated fitting or terminal on the television set. Presently, crimping tools are designed to crimp or reduce the size of the connector sleeve on the cable side of the fitting into a generally hexagonal or six-sided configuration in attaching the fitting to the end of the cable. A major problem with the hexagonal crimp, however, is that it does not completely seal off the end of the cable and permits air and moisture to enter by way of the cable end which can affect the quality of the picture and gradually erode the cable itself.

It has been proposed to radially compress fittings into a generally circular configuration and, for example, reference is made to U.S. Letters Pat. No. 5,138,864 to A. J. Tarpill which is designed specifically for use in radially compressing ribbed connector sleeves and wherein the axial length of the connector sleeve is uniformly reduced in diameter to a size which will engage the cable end. Other patents of interest in this field are U.S. Pat. Nos. 3,417,599 to W. C. Burns, 4,043,174 to A. J. Paolino, 4,266,219 to M. A. Grundfest, 4,292,833 to E. W. Lapp, 4,790,068 to K. Sato, 4,794,780 to K. Battenfeld, 4,885,928 to E. H. Davis et al and 4,953,384 to A. Baillet et al.

No one, to our knowledge, has satisfactorily devised a crimping device or tool which will achieve the desired reduction in diameter or size of the cable end of the fitting into a rounded or generally circular configuration by applying an axially directed force to the fitting, as opposed to direct radial compression. In this way, the die surface or surfaces may remain stationary during the crimping operation and can be formed to extremely close tolerances while achieving the necessary crimping force to assure uniform sealed engagement with the cable end. In this relation, it is desirable to facilitate replacement of the crimping dies in the event that they should become worn or break as well as to facilitate the interchange or substitution of different sized dies while maintaining close tolerances in the mounting and operation of the dies.

Summary of Invention

It is therefore an object of the present invention to provide for a novel and improved crimping device which is specifically adaptable for use in compressing a fitting onto the end of a cable, such as, coaxial cables.

It is another object of the present invention to provide for a novel and improved hand-held portable crimping tool for crimping hollow cylindrical sleeve portions into sealed engagement with the end of a cable.

It is a further object of the present invention to provide in a crimping tool for interchangeable dies to enable crimping of different sized connector sleeves or couplings; and further wherein one of the dies is toggle-mounted for ease of movement into and out of the crimping position with respect to the other die.

It is a still further object of the present invention to provide for a novel and improved crimping tool which is lightweight and portable, is highly versatile in use and is made up of a minimum number of parts.

It is an additional object of the present invention to provide for a novel and improved hand-held, portable crimping tool for use in crimping a fitting onto the end of a coaxial cable under sufficient crimping force to effect uniform sealed engagement with the cable end, and prevent the entry of air or moisture into the cable end.

In accordance with the present invention, a novel and improved crimping device has been devised for connecting a cable fitting having a generally tubular connector sleeve to an end of a coaxial cable wherein the sleeve is composed of a thin-walled deformable material and wherein the device comprises a die member defining a tapered cavity having a first diameter at a first end thereof corresponding to the diameter of the sleeve and a second diameter axially spaced from the first diameter which corresponds to the diameter of the cable end, carrier means axially spaced from the cavity for supporting the sleeve in facing relation to the first end of the cavity when the cable end is extended through the cavity and at least partially inserted into the sleeve, a handle, and support means pivotally mounting the handle for axial movement toward and away from the die whereby to force the sleeve axially into the cavity under sufficient force to radially contract the sleeve into a tapered configuration corresponding to that of the cavity.

In the preferred form of invention, the crimping device takes the form of a hand-held crimping tool having lever arms at one end which can be manually grasped to exert the necessary axial force on the carrier means to force the sleeve axially into engagement with the dies whereby to unformly reduce the circumference of the sleeve into a generally conical configuration snugly engaging the end of the cable. Each die is preferably comprised of split die portions, one of the portions being controlled by a toggle arm to pivot into and out of circumferential alignment with the other of the die portions to permit extension of the cable through the cavity and the other die portion being adjustably mounted to establish proper alignment and sizing of the cavity for proper crimping of the connector sleeve into the desired size. Both die portions are removably mounted in the tool so that different sized die portions can be interchangeably mounted in the tool.

The above and other objects, advantages and features of the present invention will become ore readily appreciated and understood from a consideration of the following detailed description of preferred and modified forms of the present invention when taken together with the accompanying drawings in which:

DETAILED DESCRIPTION OF PREFERRED EMBODIMENT

Figures 1, 1A, 2, 3, 4:
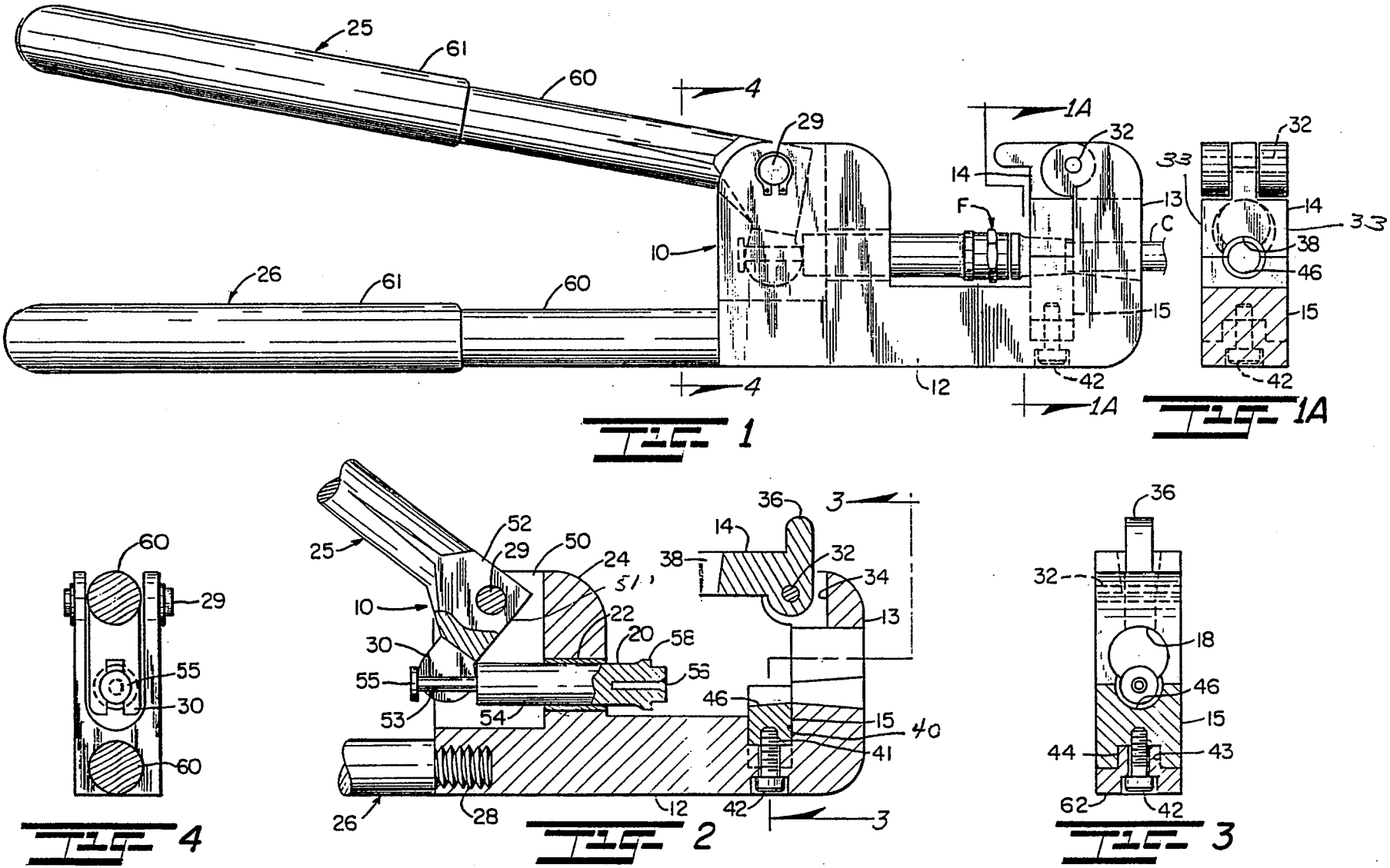
FIG. 1 is a side view in elevation of a preferred form of crimping tool in accordance with the present invention.
FIG. 1A is a view partially in section taken about lines 1A—1A of FIG. 1.
FIG. 2 is another side view partially in section of the preferred form illustrated in FIG. 1 and further illustrating a portion of the die in an open position.
FIG. 3 is a view partially taken about lines 3—3 of FIG. 2.
FIG. 4 is a cross-sectional view taken about lines 4—4 of FIG. 1.
Figure 6:
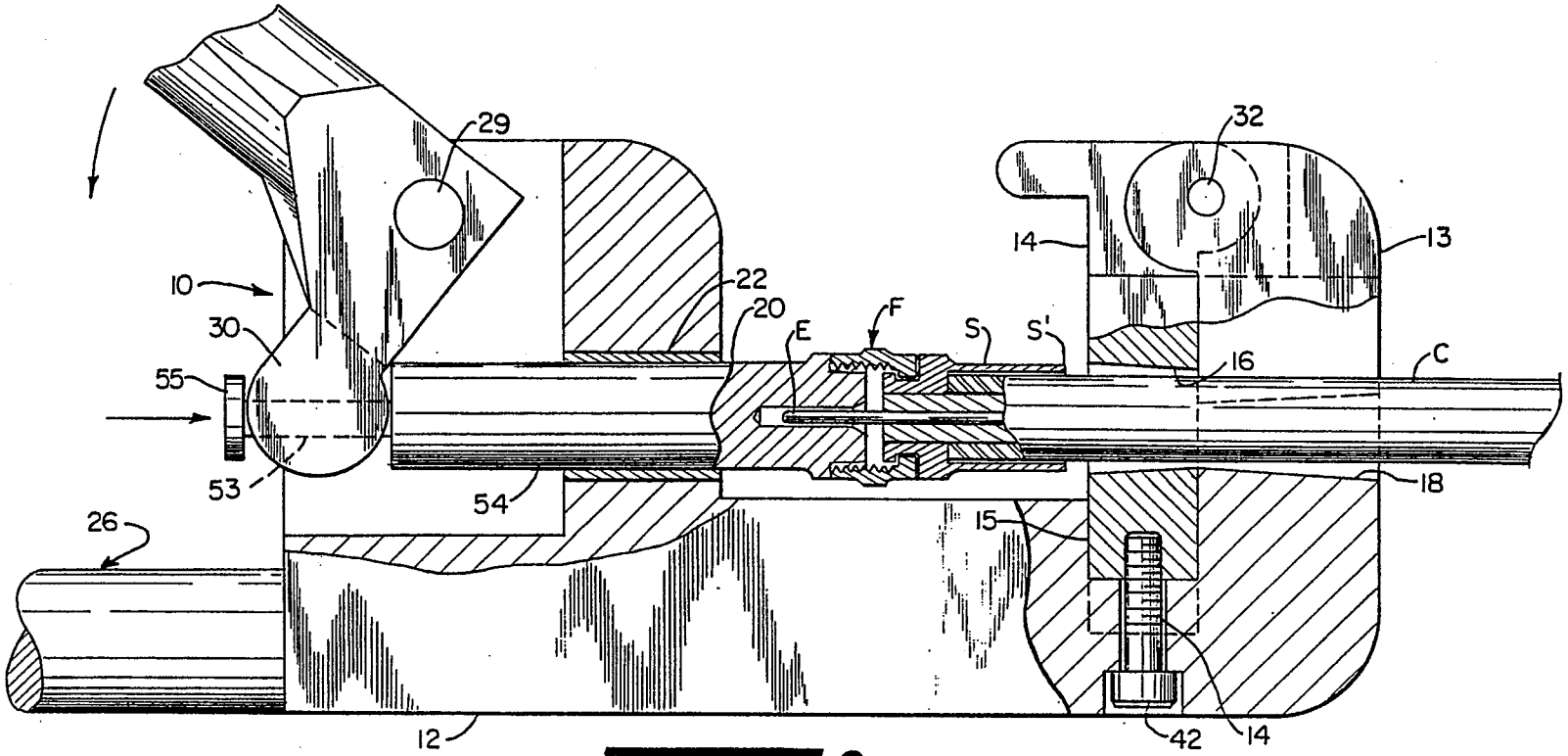
FIG. 6 is a view partially in section illustrating the disposition and arrangement of a connector sleeve and cable end as a preliminary to the crimping operation.
Figure 7:
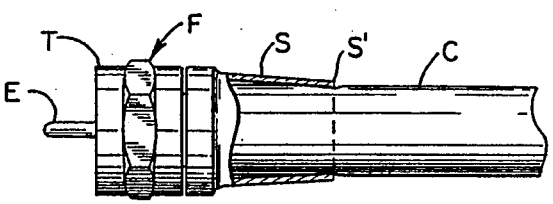
FIG. 7 is an enlarged view illustrating the manner in which the connector sleeve is crimped onto the cable end.
Figure 5:
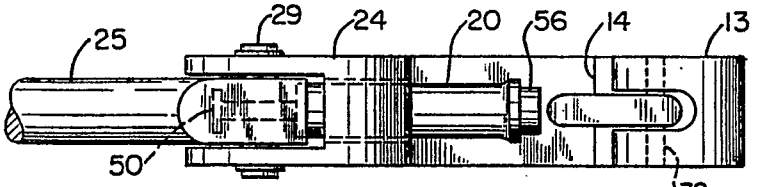
FIG. 5 is a top plan view of the crimping end of the tool of the present invention.

Referring in detail to the drawings, there is illustrated in FIGS. 1 to 7 a preferred form of crimping tool 10. As best seen from FIGS. 6 and 7, the crimping tool 10 is specifically adaptable for use in connecting a standard fitting F to one end of a conventional coaxial cable C so that the cable C may then be attached to the terminal or post on a television set. Typically, the fitting F is made up of a threaded end portion T to be connected to a terminal or post, and a hollow cylindrical connector sleeve S to be attached to the end of the cable C with a conductive element E from the cable projecting beyond the threaded end T. Again, the use of the crimping tool 10 in affixing a fitting F to the end of the cable C is given more by way of illustrative example and it will become apparent hereinafter that the tool is readily conformable for use as a force applying member in compressing or crimping other fittings or connectors.

The preferred form of crimping tool 10 is broadly comprised of a common base or body portion 12 having a die support end 13 to receive split die portions 14 and 15 which define a common tapered cavity 16 therebetween and in communication with a larger cavity 18 which is formed in the end of the body 12. A carrier 20 is in the form of a generally cylindrical chuck which is slidably disposed within a bearing 22 mounted in an opening of a support block 24 at one end of the base 12 axially spaced from the die portions 14 and 15. The carrier 20 is so positioned as to be axially spaced from but in alignment with the axis of the cavity 16. A pair of handles 25 and 26 extend away from the one end of the body 12 at an acute angle to one another, the lever arm 26 being threadedly attached as at 28 in fixed relation to the end of the base 12, and the member 25 being pivotally attached by pivot pin 29 to an upper portion of the support block with a cam portion 30 engageable with the carrier 20 to cause it to be forced in an axial direction between the position shown in FIG. 2 and that shown in FIG. 1. As described, preferably the die support end 13 and axially spaced chuck support end 24 are of unitary construction with the common base 12.

In order to permit extension of the fitting F and cable C into position between the die support end 13 and the support block 24, the upper die portion 14 is pivotally mounted by pivot pin 32 for vertical movement of the die portion 14 through a slot 34 in the upper end of the support portion 13 between a closed position as illustrated in FIG. 1 and an open or horizontal position as illustrated in FIG. 2. The die portion 14 has opposite spaced parallel side surfaces 33, an offset portion 35 to receive the pin 32, a laterally directed finger-engaging portion 36 and a generally conical end portion 38 which in the closed position defines an upper half of the common cavity 16, as illustrated in FIGS. 1 and 1A. The die portion 15 is similarly in the form of a generally rectangular block which is disposed in a slot 40 in the base, the slot being in communication with a threaded bore for an attachment bolt 42 to anchor the block 15 in place. For this purpose, the block is provided with a center slotted portion 43 which is complementary to a raised portion 44 in the body of the base member 12 to cooperate with the connecting bolt 42 in rigidly positioning the lower die portion 15 in place. The upper surface of the die portion 15 includes a generally semi-conic surface 46 which tapers rearwardly along a predetermined angle corresponding to that of the upper die surface 38 so as to form with the upper die surface 38 the tapered cavity 16 in communication with the opening 18. The opening 18 is enlarged in relation to the cavity 16 and is of generally circular configuration but with a rearwardly flared lower end surface 48 extending away from the lower die surface 46.

The support block 24 defines an upright extension of the base 12 at the one end opposite to the die support end 13 and is provided with an upper, open vertical slot 50 for insertion of pivotal end 52 of the handle 25. The end 52 includes a squared end surface 51, and the cam member 30 defines a lateral projection away from the pivotal end 52. The cam 30 is of generally rounded configuration and further is bifurcated or slotted, as illustrated in FIG. 4, to fit over rod 53 at the trailing end of the chuck 20. The cam member 30 is interpositioned between an elongated cylindrical chuck body 54 and an enlarged end 55 of the rod 53. The opposite end of the body 54 is bifurcated or split as at 56 in an axial direction and a shoulder 58 serves as an end stop to limit the depth of insertion of the end of the chuck 20 into the threaded end T of a fitting F to be crimped.

Preferably, the lower handle member 56 is in the form of an elongated rod 60 having a gripping surface 61, the handle extending horizontally from its threaded connection at 28 to the end of the base 12. The base 12 has a flat bottom surface 62 so that the tool can be placed on a table or other surface in an upright position as shown. In crimping, a fitting F is loosely assembled onto the end of a cable C, and the pivotal die portion 14 is lifted as illustrated in FIG. 2 so that the assembled fitting F and cable C can be inserted from the end of the die support portion 13 through the opening 48 and the threaded end T of the fitting F advanced over the end of the chuck into engagement with the shoulder 58. The die portion 14 is then pivoted downwardly into the closed position as shown in FIG. 1 in alignment with the lower die 15 and in surrounding relation to the cable C. In this relationship, the die surfaces 38 and 46 are tapered at a corresponding angle so as to form a uniform reduction in diameter from the enlarged end of the cavity 16 which faces the chuck to the reduced end nearest to the opening 48, the degree of taper being selected such that the reduced end will cause the connector sleeve S on the fitting F to sealingly engage the outer surface of the cable C.

The upper handle 25 extends at a relatively low gradual angle away from the support block 24, the handle 25 being of the same length as the lower handle 26 and correspondingly including an elongated rod 60 and gripping surface 61. Once the fitting F has been assembled as described onto the chuck, the handle 25 is manually grasped and forced downwardly toward the handle 26 causing the cam member 30 to drive the chuck forwardly in an axial direction until the connector sleeve S enters the cavity 16. Thus, the pivotal action of the upper handle 25 as it is forced downwardly toward the lower handle 26 is converted into an axial force along the axis of the chuck body 54 and which will cause the leading end S' of the sleeve to gradually contract into a tapered configuration corresponding to that of the cavity 16 as it is axially advanced through the cavity 16. When the leading end S' reaches the end of the cavity, it will have contracted into firm engagement with the cable end C while retaining its circular configuration thereby effecting uniform sealed engagement with the cable which will prevent the entry of air or moisture between the fitting and cable when in use. By the application of an axial force as described, it is possible to advance the sleeve into a stationary die member and, as a result, the die cavity can be formed to extremely close tolerances and be rigidly anchored as described during the crimping operation.

The crimping tool of the present invention lends itself well to easy interchangeability of the die portions 14 and 15 to accommodate different sizes and types of fittings or couplings. Accordingly, by the simple expedient of removing the pivot pin 32, the upper die portion 14 can be easily replaced; and similarly, by removal of the bolt 42, the lower die portion 15 can be replaced. This is of value not only to permit interchangeability of the desired size of die portions 14 and 15 but to permit their replacement when they become worn.

Cable fittings F of the type described are customarily made of brass. Although the fitting F as illustrated has a sleeve with a smooth external surface, the tool 10 of the present invention is equally useful with connector sleeves S having spaced circumferentially extending ribs on their external surfaces.

It will be evident from the foregoing that the degree of axial force may be varied by modifying the length of the handles 25 and 26 and altering the distance between the cam 30 and pivot pin 29. Furthermore, while the tool has been described as being placed on a stationary surface with the lower handle resting on the surface, it is readily conformable for use by grasping both handles 25 and 26 in one or both hands and applying the necessary pressure to crimp the sleeve and, in this regard, is sufficiently small or compact and lightweight that it can be carried on one's person when not in use.

Detailed Description of Modified Form of Invention

Figure 8:
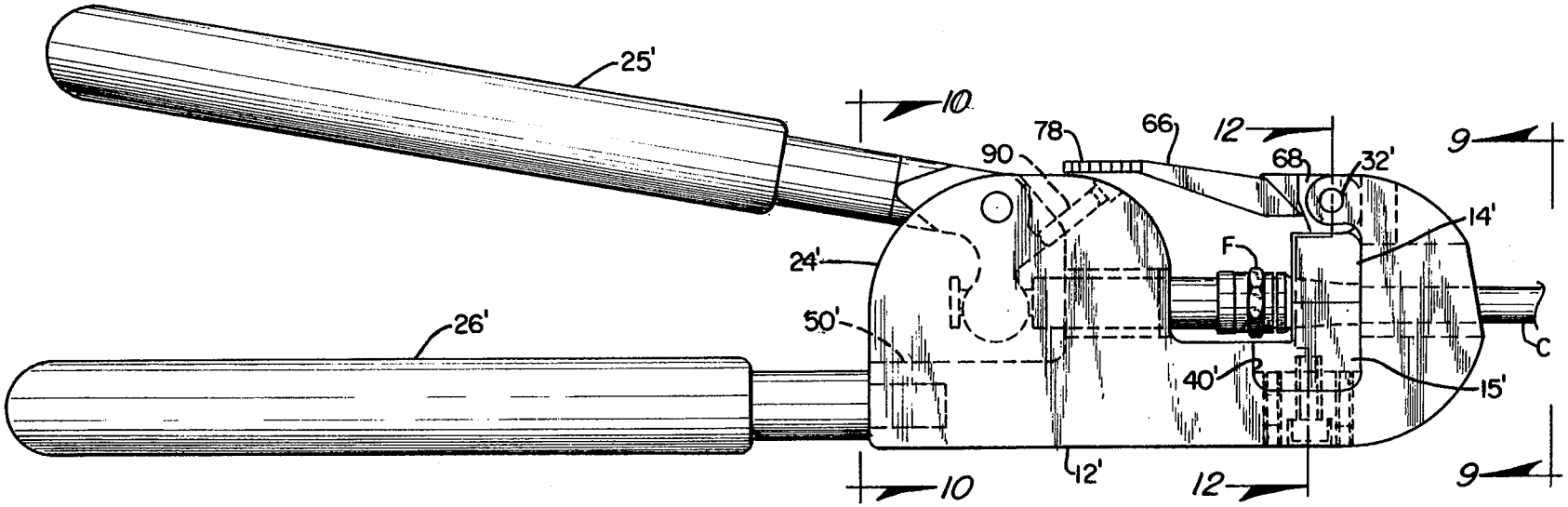
FIG. 8 is a side view of a modified form of crimping tool in accordance with the present invention.
Figure 12:
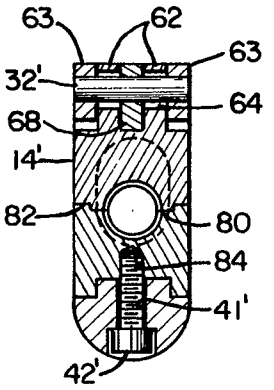
FIG. 12 is a cross-sectional view taken about lines 12—12 of FIG. 8.
Figure 11:
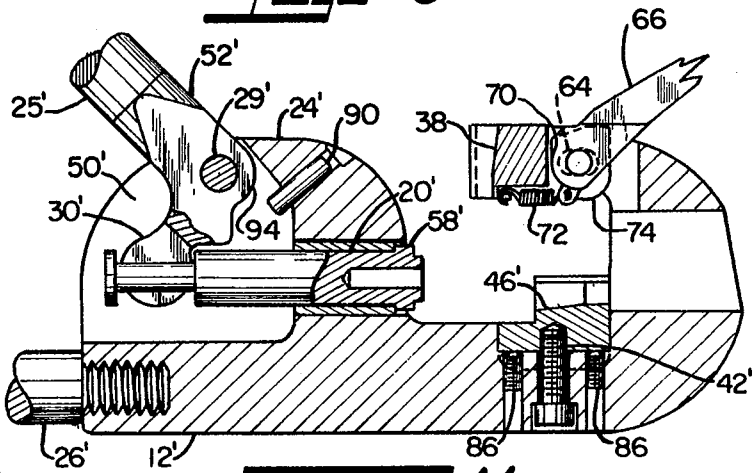
FIG. 11 is a sectional view through the body portion of the modified form of crimping tool shown in FIG. 8.
Figure 10:
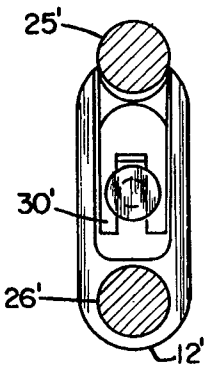
FIG. 10 is a sectional view taken about lines 10—10 of FIG. 8.
Figure 9:
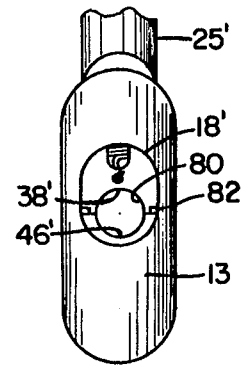
FIG. 9 is a view taken about lines 9—9 of FIG. 8.

A modified form of invention is illustrated in FIGS. 8 to 15 wherein like parts are correspondingly enumerated with prime numerals. Broadly, the modified form of invention is intended to achieve the same result as the preferred form in providing a hand-crimping tool 10' which is capable of reducing the diameter of a connector sleeve into a generally circular configuration by the application of an axially directed force to the fitting. However, the mounting and disposition of the split die portions 14' and 15' are modified to the end of achieving still greater precision and tolerance control during the crimping operation as well as to facilitate release of the pivotal die portion 14' from engagement with the connector sleeves S at the conclusion of the crimping operation. Thus, the die portion 14' has a bifurcated extension 62 of reduced width which is inserted between spaced bosses 63 at the upper end of the die support end 13'. A closed slot 64 is aligned with openings in the bosses 63 for insertion of a pin 32' to permit combined pivotal and sliding movement of the die portion 14' about the pin 32'. A toggle arm 66 has a forward extension 68 of reduced width which is inserted into a bifurcated extension 62 and is also pivotal about the pin 32'. A cam surface 70 on the undersurface of the extension 62 is movable into engagement with an upper surface of the die portion 50, and the die portion 14' is biased in an upward direction under the urging of a coil spring 72 which extends through a slot 74 in the rear surface of the die portion 15' the spring having an upper end anchored to one end of the extension 60 and a lower end anchored at the lower end of the slot 74. The closed slot 64 is elongated in a direction parallel to the spring 72 so that, when the arm 66 is in an open or raised position as shown in FIG. 4, the urging of the spring 72 will cause the die portion 15' to be retracted against the rounded undersurface portion of the extension 68 at the least distance away from the opening in the extension for the pivot pin 32', and the pivot pin 32' is also free to slide through the closed slot 64 in retracting the die portion 14' under the urging of the spring 72. When the toggle arm 66 is pivoted toward the closed position, as shown in FIG. 8, the die portion 14' is caused to abut the end wall of the die support end 13' which surrounds the cavity 18' prior to the end of travel of the arm 66, and continued pivotal movement of the arm 66 will then cause the cam surface 70 to slide along the upper surface of the die portion and by virtue of the increasing thickness or distance of the cam surface from the opening in the extension 68 for the pin 32' will cause the die portion 14' to slide downwardly toward the lower die portion 15' against the urging of the spring 72.

The arm 66 is tapered slightly in a direction away from the extension 68 and terminates in a free end 78 which bears against the support block 24' when it reaches the closed position. The die portions 14' and 15' have die surfaces 38' and 46' respectively, of generally semi-conic configuration as in the preferred form. However, complementary ribs 80 and grooves 82 on confronting surfaces of the die portions 14' and 15', respectively, will interengage with one another as the die portion 14' is advanced into the closed position with respect to the die portion 15', as best seen from FIGS. 9 and 12.

The lower die portion 15' is disposed in a broad slot 40' in the base of the support end portion 13' and has a threaded counter bore 84 aligned with a through bore 41' in the base to receive a bolt 42'. In order to permit adjustable mounting of the die portion 15' Allen head screws 86 are inserted in bores 87 on opposite sides of the bolt 42 to bear against the bottom surface of the die portion 15' so that the die portion can be adjusted in a direction toward and away from the die portion 14' and be locked firmly in place. This fine adjustment for the lower die portion 15' assures that the proper clearance and alignment is provided between the die portions 14' and 15' when the arm 66 causes the upper die portion 14' to move into engagement with the lower die portion 15' and will effectively compensate for the use of different sized dies.

Another adjustment feature in the modified form of invention is the utilization of an adjustable stop member 90 in the support block 24'. The stop 90 is preferably defined by an Allen head screw extending in a rearward and downward diagonal direction through a bore 92 which communicates with the slot 50' for the pivotal end 52' of handle 25'. The end portion 52' includes a rounded portion 94 provided with apertures for insertion of a pivot pin 29' and a protrusion 96 between the rounded portion and the cam portion 30'. The protrusion moves into engagement with the adjustable stop when the handle 25' is forced toward the handle 26' thereby to limit the depth of insertion of the end of the sleeve S into the cavity 16' between the die portions 14' and 15'.

Figure 13:
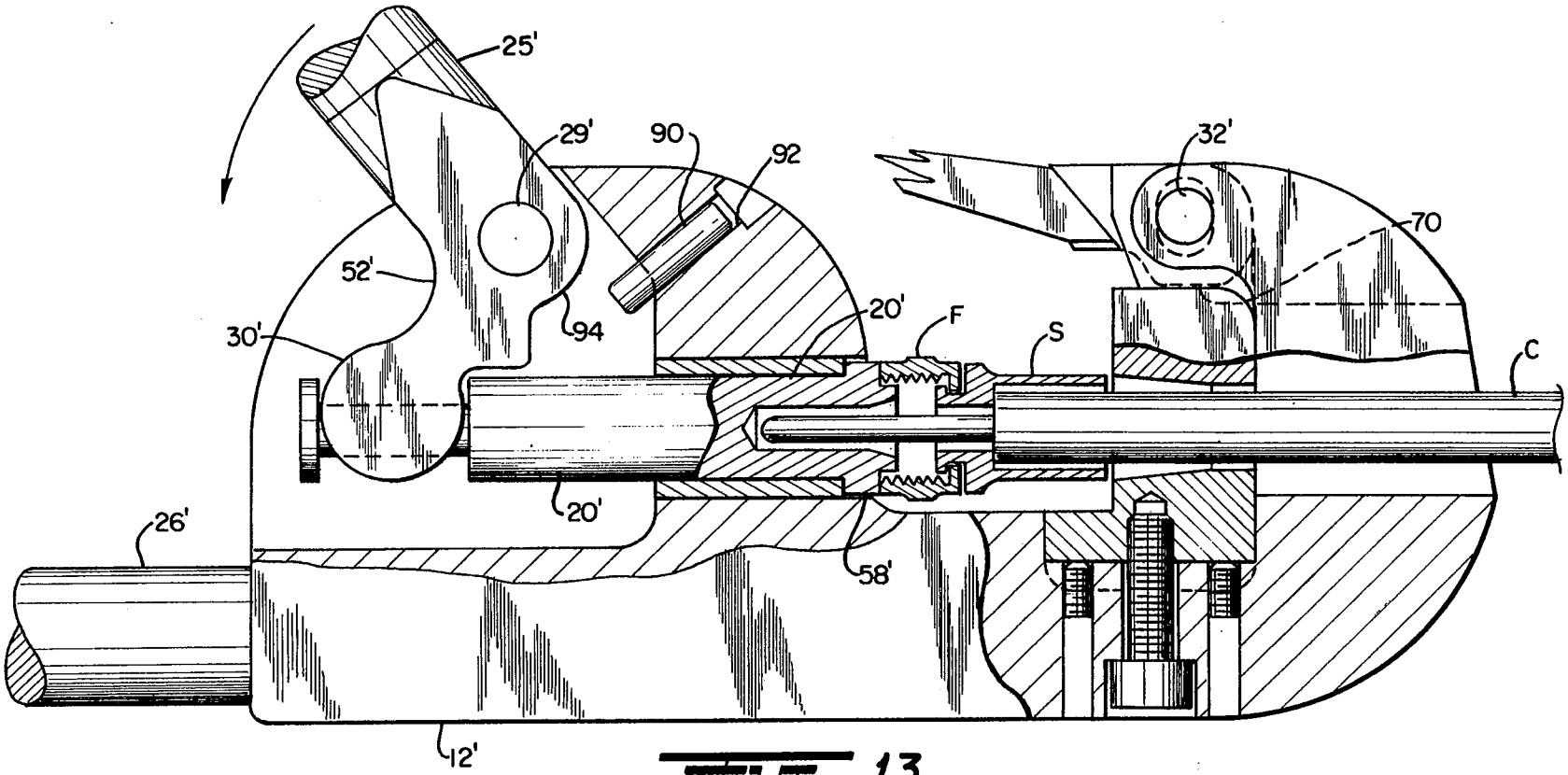
FIG. 13 is an enlarged view partially in section of a connector sleeve and cable end mounted in the body portion preliminary to the crimping operation.
Figure 15:
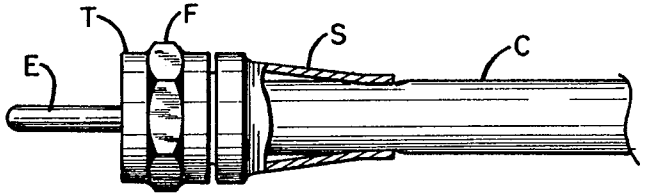
FIG. 15 is an enlarged view of a connector sleeve and cable end following the crimping operation.
Figure 14:
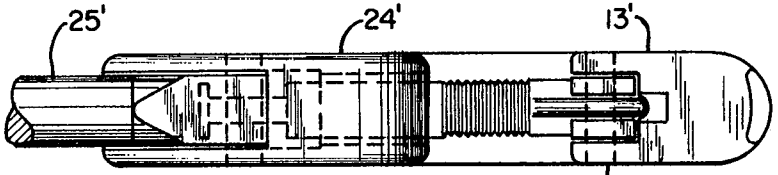
FIG. 14 is a top plan view of the modified form of crimping tool shown in FIG. 8.

In practice, referring to FIGS. 13 to 15, the lever arm 66 is raised away from the cavities 16' and 18' to afford sufficient clearance for insertion of the end of a cable C and fitting F through the cavity until the threaded end T of the fitting F is advanced over the end of the chuck 20' into engagement with shoulder 58'. The upper die portion 14' is then pivoted downwardly by the arm 66 into the closed position, as shown in FIG. 13, in confronting relation to and engagement with the upper surface of the die portion 15'. The handle 25' is manually grasped and forced inwardly toward the handle 26 to cause the cam member 30' to drive the chuck 20' in an axial direction forcing the connector sleeve S into the cavity 16' and cause the leading end S' of the sleeve to gradually contract into a tapered configuration corresponding to that of the cavity 16'. Once the leading end S' reaches the end of the cavity 16' it will have contracted into firm engagement with the cable end C while retaining its circular configuration and effect uniform sealed engagement with the cable C in order to prevent the entry of air or moisture between the fitting F and cable C when in use. Another advantage of the lever arm 66 is that it is able to easily release the die portion 14' from engagement with the fitting F by raising the arm and removing the cam surface 70 from engagement with the upper surface of the die portion 15' so that the die portion 15' can easily retract in an upward direction away from the fitting F. The assembled cable C and fitting F may then be removed through the cavity 18' and is ready for use.

It is therefore to be understood that while a preferred embodiment of the present invention is herein set forth and described, the above and other modifications and changes may be made without departing from the spirit and scope of the invention as defined by the appended claims and reasonable equivalents thereof.

We claim:

1. A crimping device for connecting a cable fitting having a generally tubular connector sleeve to an end of a coaxial cable wherein said sleeve is composed of a thin-walled deformable material, said device comprising:

a die member defining a tapered cavity having a first diameter at a first end thereof substantially corresponding to an outer diameter of said sleeve and a second diameter axially spaced from said first diameter which substantially corresponds to an outer diameter of said cable end;

carrier means axially spaced from said cavity for supporting said sleeve in facing relation to said first end of said cavity with said cable end extending through said cavity and at least partially inserted into said sleeve; and support means mounting said carrier for axial movement toward and away from said die member whereby to force said sleeve axially into said cavity under sufficient force to radially contract said sleeve into a tapered configuration conforming with said tapered cavity of said die to thereby connect said sleeve to said end of said cable.

2. A crimping device according to claim 1, including means for expanding said cavity for axial insertion of said fitting and said cable end through said cavity into engagement with said carrier means.

3. A crimping device according to claim 1, said die member having segmental die portions defining circumferential portions of said cavity, at least one of said die portions being movable into and out of circumferential alignment with the other of said die portions.

4. A crimping device according to claim 3, including pivot means for pivoting said one die portion into and out of circumferential alignment with said other of said die portions.

5. A crimping device according to claim 3, including a base member, a handle including one handle member extending horizontally from one end of said base member, and a circumferential slot in said base member, said one of said die portions being removably inserted into said slot, and means for rigidly anchoring said one of said die portions in said slot.

6. A crimping device according to claim 3, including a base member having said support means at one end of said base member, a die support at an opposite end of said base member, and a pivotal handle mounted on said support means.

7. A crimping device according to claim 6, including means removably mounting said die portions on said die support.

8. A crimping device according to claim 1, including a force-applying means on said support means for applying an axial force to said carrier means.

9. A portable crimping tool for connecting a cable fitting having a generally tubular connector sleeve to an end of a coaxial cable wherein said sleeve is composed of a thin-walled deformable material, said tool comprising:

a die member defining a tapered cavity having a first diameter at a first end thereof corresponding to an inner diameter of said sleeve and a second diameter axially spaced from said first diameter which corresponds to an outer diameter of said cable end;

a chuck member axially spaced from said cavity, said sleeve disposed on one end of said chuck in alignment with said first end of said cavity with said cable end extending through said cavity and at least partially inserted into said sleeve;

a pivotal handle; and support means pivotally mounting said pivotal handle for axial movement of said chuck member toward and away from said die whereby to force said sleeve axially into said cavity under sufficient force to uniformly reduce a circumferential portion of said sleeve into a generally conical configuration conforming with said tapered cavity of said die snugly engaging said end of said cable.

10. A crimping tool according to claim 9, including means for expanding a portion of said cavity for axial insertion of said fitting and said cable end through said cavity into engagement with said chuck member.

11. A crimping tool according to claim 9, said die member having segmental die portions defining circumferential portions of said cavity, at least one of said die portions being movable into and out of circumferential alignment with the other of said die portions.

12. A crimping tool according to claim 11, including pivot means for pivoting said one die portion into and out of circumferential alignment with said other of said die portions.

13. A crimping tool according to claim 9, including a base member having said support means mounted at one end of said base member, a die support member at an opposite end of said base member, and said handle mounted for pivotal movement on said support means.

14. A crimping tool according to claim 13, including a second handle member fixed to said base member, and said pivotal handle extending from said support means at an acute angle to said second handle.

15. A crimping device for connecting a cable fitting having a generally tubular connector sleeve to an end of a coaxial cable wherein said sleeve is composed of a thin-walled deformable material, said device comprising:

a die member defining a tapered cavity having a first diameter at a first end thereof substantially corresponding to an outer diameter of said sleeve and a second diameter axially spaced from said first diameter which substantially corresponds to an outer diameter of said cable end, said die member having segmental die portions defining circumferential portions of said cavity, at least one of said die portions being movable into and out of circumferential alignment with the other of said die portion, pivot means for pivoting said one die portion into and out of circumferential alignment with said other of said die portions including a lever arm having a cam member engageable with said one die portion in advancing said one die portion into circumferential alignment with said other die portion;

carrier means axially spaced from said cavity for supporting said sleeve in facing relation to said first end of said cavity with said cable end extending through said cavity and at least partially inserted into said sleeve; and support means mounting said carrier for axial movement toward and away from said die member whereby to force said sleeve axially into said cavity under sufficient force to radially contract said sleeve into a tapered configuration conforming with said tapered cavity of said die to thereby connect said sleeve to said end of said cable.

16. A crimping device according to claim 15, including biasing means for biasing said one die portion away from said other die portion, said cam member overcoming said biasing means when said lever arm advances said one die portion into circumferential alignment with said other die portion.

17. A crimping device according to claim 15, including biasing means defined by a spring member interposed between said one die portion and said lever arm for normally urging said one die portion away from said other die portion.

18. A crimping device according to claim 15, said other die portion including means adjustably mounting said other die portion to vary the circumferential spacing between said other die portion and said one die portion.

19. A crimping device according to claim 18, including an end support member, said other die portion disposed in a slot in said end support member, and said adjusting means including a threaded adjusting member between said end support and said other die portion, and a locking member disposed between said end support and said other die portion.

20. A crimping device according to claim 15, a pivotal handle, and support means pivotally mounting said pivotal handle for axial movement of said carrier toward and away from said die member, and adjustable end stop means in the path of movement of said handle to limit the axial movement of said carrier toward said die member.

* * * * *